United States Patent [19]

Usui et al.

[11] Patent Number: 4,778,339

[45] Date of Patent: Oct. 18, 1988

[54] FAN BLADE

[75] Inventors: Masayoshi Usui, Numazu; Hiroshi Kanesaka, Kawasaki, both of Japan

[73] Assignee: Usui Kokusai Sangyo Kabushiki Kaisha, Shizuoka, Japan

[21] Appl. No.: 145,624

[22] Filed: Jan. 19, 1988

[30] Foreign Application Priority Data

Jan. 26, 1987 [JP] Japan ..... 62-15793

[51] Int. Cl.[4] ..... F04D 29/36

[52] U.S. Cl. ..... 416/39; 415/12

[58] Field of Search ..... 416/39; 415/12

[56] References Cited

U.S. PATENT DOCUMENTS

| | | | |
|---|---|---|---|
| 2,114,567 | 4/1938 | Mercur | 416/39 X |
| 3,042,371 | 7/1962 | Fanti | 415/12 X |
| 3,373,930 | 3/1968 | Rom | 415/12 X |
| 3,764,227 | 10/1973 | Albertzart | 416/39 |

FOREIGN PATENT DOCUMENTS

| | | | |
|---|---|---|---|
| 1528887 | 10/1969 | Fed. Rep. of Germany | 416/39 |
| 3044307 | 6/1982 | Fed. Rep. of Germany | 416/39 |
| 947118 | 1/1964 | United Kingdom | 416/39 |
| 1021376 | 3/1966 | United Kingdom | 415/12 |
| 1272645 | 5/1972 | United Kingdom | 416/39 |
| 1319193 | 6/1973 | United Kingdom | 416/39 |

*Primary Examiner*—Everette A. Powell, Jr.

*Attorney, Agent, or Firm*—Anthony J. Casella; Gerald E. Hespos

[57] ABSTRACT

A fan blade which makes use of the difference in the thermal expansion coefficient to enable the angle of attack to be variable without a substantial change in the camber quantity and without the need to employ a temperature-sensitive fan clutch. The blade is provided with two plate-like members having a smaller thermal expansion coefficient than that of the blade in such a manner that one of the plate-like members is provided on the suction-side surface of the blade so as to extend from the forward edge portion at the distal end of the blade toward the rearward edge portion at the proximal end of the blade, and the other plate-like member is provided on the delivery-side surface of the blade so as to extend from the rearward edge portion at the distal end of the blade toward the forward edge portion at the proximal end of the blade, that is, the two plate-like members provided on the obverse and reverse surface, respectively, of the blade cross each other in a substantially X-shape. Accordingly, the angle of attack of the blade is made variable in accordance with a change in temperature of the air delivered by the fan. The blade may be made of a resin material, while the plate-like members may be made of a metal.

7 Claims, 3 Drawing Sheets

PRIOR ART

FAN BLADE

BACKGROUND OF THE INVENTION

1. Field of the Invention

The present invention relates to a structure of a blade for a fan which is generally used to deliver cooling air or the like in automotive engines or various other kinds of apparatus.

2. Description of the Prior Art

A typical conventional variable-pitch type fan blade is exemplarily shown in FIGS. 5 and 6. As illustrated, blades 12 are provided on a boss member 11 so as to project outward from the outer peripheral surface of the latter, and a bimetal 15 is provided substantially all over the deliveryside surface of each blade 12 so that, as the temperature of the air delivered by the fan rises, the bimetal 15 is deformed to increase the quantity of camber C of the blade 12, thereby increasing the quantity of air delivered when the air temperature is relatively high, whereas, when the temperature of the air delivered is relatively low, the camber quantity C is reduced to decrease the quantity of air delivered, thus reducing the fan driving power and the fan noise.

The above-described prior art fan blade structure suffers, however, from the following problems. The deformation of the blade 12 caused by the deformation of the bimetal 15 that takes place in accordance with a change in temperature of the air delivered mainly changes the camber quantity C but causes substantially no change in the angle of attack $\alpha$, as shown in FIG. 7. Accordingly, it is impossible, with an increase in the camber quantity C alone, to obtain a substantial increase in the quantity of air delivered, and therefore the expected object cannot be attained. For this reason, it is necessary to employ a temperature-sensitive fan clutch, which results in complication of the control mechanism, an increase in the overall size of the apparatus, and also an increase in the weight of the product.

SUMMARY OF THE INVENTION

In view of these circumstances, it is a primary object of the present invention to provide a fan blade which is so designed that it is possible to vary the angle of attack without a substantial change in the camber quantity and without the need to employ the above-described temperature-sensitive fan clutch so that, when the temperature of the air delivered is high, a maximum air quantity is obtained, whereas, when the air temperature is low, the quantity of air delivered is reduced to lower the noise level.

To this end, the present invention provides a fan blade comprising: two plate-like members having a smaller thermal expansion coefficient than that of the blade, one of the plate-like members being provided on the suction-side surface of the blade so as to extend from the forward edge portion at the distal end of the blade toward the rearward edge portion at the proximal end of the blade, and the other plate-like member being provided on the delivery-side surface of the blade so as to extend from the rearward edge portion at the distal end of the blade toward the forward edge portion at the proximal end of the blade, so that the two plate-like members provided on the obverse and reverse surfaces, respectively, of the blade cross each other in a substantially X-shape, whereby the angle of attack of the blade is made variable in accordance with a change in temperature of the air delivered by the fan.

The above-described blade may be made of a resin material, while the plate-like members may be made of a metal.

BRIEF DESCRIPTION OF THE DRAWINGS

The above and other objects, features and advantages of the present invention will become apparent from the following description of the preferred embodiments thereof, taken in conjunction with the accompanying drawings, in which like reference numerals denote like elements, and in which.

DETAILED DESCRIPTION OF PREFERRED EMBODIMENTS

Figure 1:
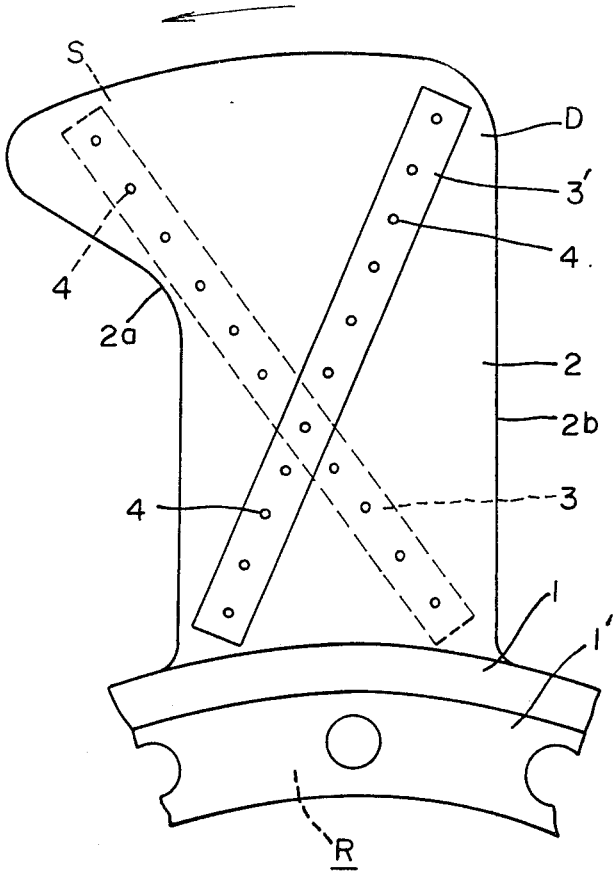
FIG. 1 is a fragmentary front view showing a fan blade made of a resin material in accordance with one embodiment of the present invention.
Figure 2:
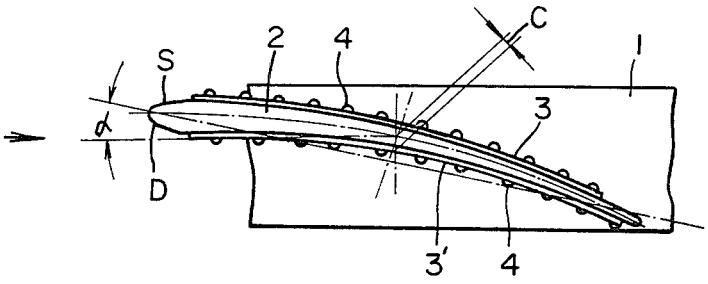
FIG. 2 is a plan view of the fan blade shown in FIG. 1 at the time when the temperature of the air delivered thereby is relatively low.

One embodiment of the present invention will be described hereinunder in detail with reference to FIGS. 1 to 3.

Referring to the figures, the reference numeral 1 denotes an annular boss member having a mounting wall 1' which is secured to a rotary member R, for example, an impeller shaft, provided on a water pump through a pulley or the like. A plurality of fan blades 2 are provided on the boss member 1 so as to project radially outward from the outer peripheral surface of the boss member 1. Each blade 2 is made of, for example, polypropylene, and plate-like members 3 and 3' are rigidly secured to the obverse and reverse surfaces, respectively, of the blade 2 by means, for example, of rivets 4, in such a manner that the plate-like member 3 is provided on the suction-side surface S of the blade 2 so as to extend from the forward edge portion **2*a* at the distal end of the blade 2 toward the rearward edge portion 2*b* at the proximal end, while the plate-like member 3' is provided on the delivery-side surface D so as to extend from the rearward edge portion 2*b* at the distal end of the blade 2 toward the forward edge portion 2*a* at the proximal end, that is, the plate-like members 3 and 3' cross each other in a substantially X-shape, as shown in FIGS. 1 and 2. The plate-like members 3 and 3' are made of a material having a smaller thermal expansion coefficient than that of the blade 2**, for example, steel.

Figure 3:
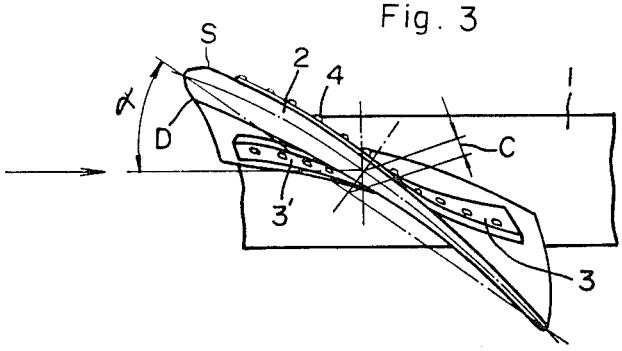
FIG. 3. is a plan view of the fan blade shown in FIG. 1 at the time when the temperature of the air delivered thereby is relatively high.

By virtue of the above-described arrangement of this embodiment, when the temperature of the air delivered by the fan rises to 50° C., it is possible to increase the angle of attack $\alpha$ of the blade 2 by about 15°, as shown in FIG. 3.

Another embodiment of the present invention will next be explained with reference to FIG. 4.

Figure 4:
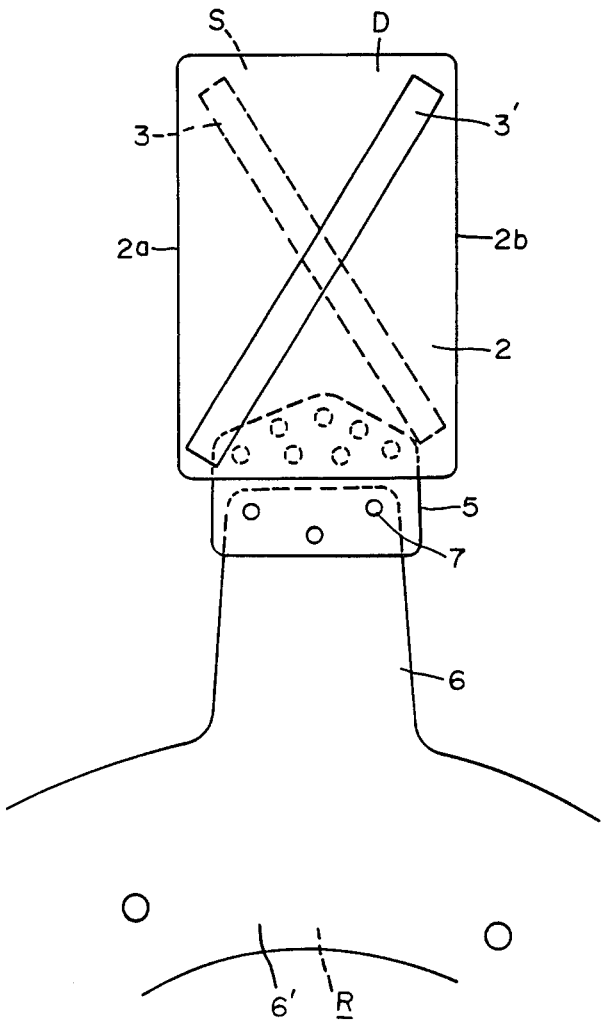
FIG. 4 is a fragmentary front view showing another embodiment of the present invention, which corresponds to FIG. 1.
Figure 5:
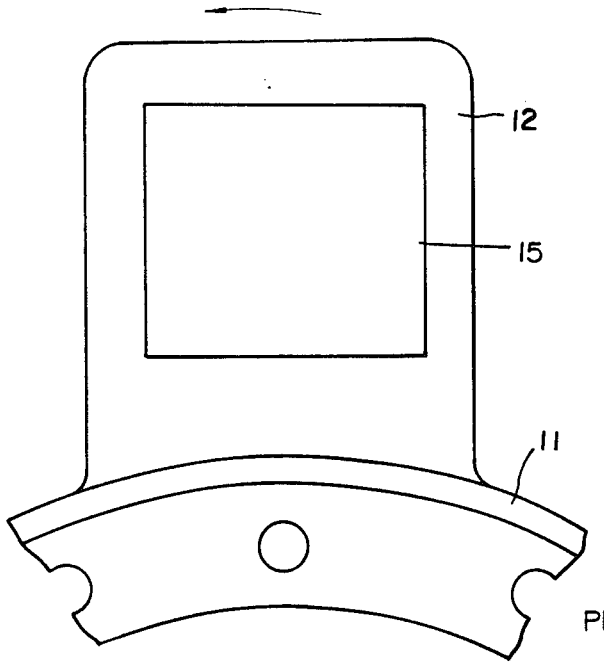
FIGS. 5 to 7 show in combination a prior art, which correspond to FIGS. 1 to 3, respectively.
Figure 6:
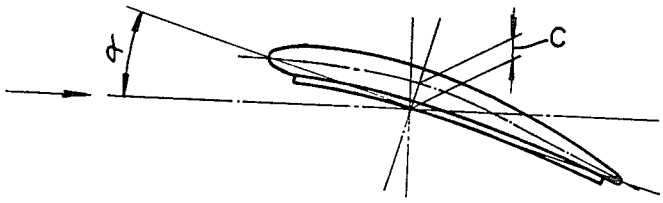
PRIOR ART Fig. 6
Figure 7:
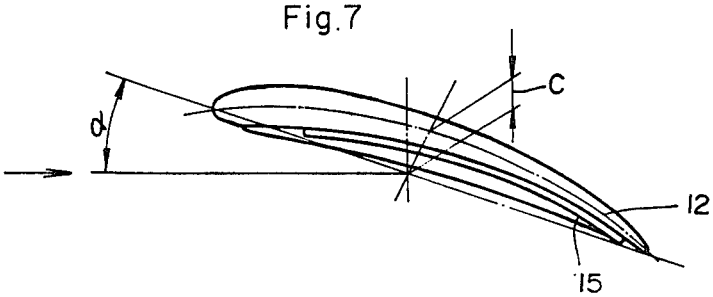
PRIOR ART Fig. 7

In FIG. 4, the reference numeral 6 denotes a spider having a mounting wall 6' which is secured to a rotary member R, and a plurality of fan blades 2 are rigidly secured to the outer periphery of the spider 6 by means of rivets 7 through respective blade inserts 5 (described later) in such a manner that the blades 2 project therefrom radially outward. Each blade 2 is made of, for example, nylon 66, and plate-like members 3 and 3' made of steel are provided integral with the blade 2, together with the blade insert 5, when the blade 2 is formed by molding process, in such a manner that the plate-like member 3 is provided on the suction-side surface S of the blade 2 so as to extend from the forward edge portion 2*a* at the distal end of the blade 2 toward the rearward edge portion 2*b* at the proximal end, while the plate-like member 3' is provided on the delivery-side surface D so as to extend from the rearward edge portion 2*b* at the distal end of the blade 2 toward the forward edge portion 2*a* at the proximal end, that is, the plate-like members 3 and 3' cross each other in a substantially X-shape, in the same way as in the embodiment shown in FIGS. 1 and 2.

In this embodiment having the above-described arrangement, when the temperature of the air delivered by the fan rises to 50° C., it is possible to increase the angle of attack $\alpha$ of the blade 2 by about 10° and hence increase the quantity of air delivered. Thus, it is possible to attain the desired object.

According to the present invention having the foregoing arrangement, as the temperature of the air delivered by the fan rises, each blade expands to a substantial extent on heating, but the plate-like members, which have a relatively small thermal expansion coefficient, expand only slightly. The difference in the degree of thermal expansion between the two different kinds of member causes the blade to be deformed by means of two pulling forces which act in such a manner that, at the suction-side surface of the blade, the forward edge portion at the distal end of the blade is pulled toward the rearward edge portion at the proximal end, whereas, at the delivery-side surface of the blade, the rearward edge portion at the distal end of the blade is pulled toward the forward edge portion at the proximal end. These two pulling forces, which act in the form of moments, cause the attack angle $\alpha$ of the blade to change to a substantial extent.

Thus, the present invention makes use of the difference in the thermal expansion coefficient between the material of each fan blade and the material of the plate-like members provided on the fan blade to change the attack angle of the fan blade to a substantial extent in accordance with the rise in the ambient temperature, for example, the temperature of the air delivered by the fan in actual use, thereby enabling a maximum air quantity to be ensured at the time of high temperature without the need to employ a temperature-sensitive fan clutch which is costly and heavy in weight. Further, it is also possible to provide the plate-like members integral with the fan blade when formed by molding process, and therefore it is possible to manufacture the fan blade with ease and at considerably low cost. Thus, it is possible according to the present invention to obtain a useful and advantageous fan blade.

Although the present invention has been described through specific terms, it should be noted here that the described embodiments are not necessarily exclusive and various changes and modifications may be imparted thereto without departing from the scope of the invention which is limited solely by the appended claims.

What is claimed is:

1. A fan blade comprising:

two plate-like members having a smaller thermal expansion coefficient than that of said blade, one of said plate-like members being provided on the suction-side surface of said blade so as to extend from the forward edge portion at the distal end of said blade toward the rearward edge portion at the proximal end of said blade, and the other plate-like member being provided on the delivery-side surface of said blade so as to extend from the rearward edge portion at the distal end of said blade toward the forward edge portion at the proximal end of said blade, so that said two plate-like members provided on the obverse and reverse surfaces, respectively, of said blade cross each other in a substantially X-shape, whereby the angle of attack of said blade is made variable in accordance with a change in temperature of the air delivered by the fan.

2. A fan blade according to claim 1, wherein said blade is made of a resin material.

3. A fan blade according to claim 1, wherein said plate-like members are made of a metal.

4. A fan blade according to claim 1, wherein said blade is secured to an annular boss member having a mounting wall which is secured to a rotary member.

5. A fan blade according to claim 1, wherein said blade is secured to a spider through a blade insert, said spider having a mounting wall which is secured to a rotary member.

6. A fan blade according to claim 2, wherein said resin material is either polypropylene or nylon 66.

7. A fan blade according to claim 3, wherein said metal is steel.

* * * * *